US008333923B2

(12) United States Patent
Jaszarowski et al.

(10) Patent No.: US 8,333,923 B2
(45) Date of Patent: Dec. 18, 2012

(54) HIGH STRENGTH GRAY CAST IRON

(75) Inventors: James K. Jaszarowski, Washington, IL (US); Ronald Wayne Conklin, Pekin, IL (US); Leonard Wade Matheny, Peoria, IL (US); John Warren Edenburn, Peoria, IL (US); Kelly Brockhouse, legal representative, Channnahon, IL (US); Michael Joseph Motyl, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 1335 days.

(21) Appl. No.: 11/711,718

(22) Filed: Feb. 28, 2007

(65) Prior Publication Data

US 2008/0206584 A1 Aug. 28, 2008

(51) Int. Cl.
*C22C 37/00* (2006.01)

(52) U.S. Cl. ..... 420/27; 420/13; 428/544

(58) Field of Classification Search ..... 420/27
See application file for complete search history.

(56) References Cited

U.S. PATENT DOCUMENTS

| | | | | |
|---|---|---|---|---|
| 3,674,576 | A | 7/1972 | Van-der Ben et al. | |
| 3,893,873 | A | 7/1975 | Hanai et al. | |
| 3,909,202 | A * | 9/1975 | Becker et al. | 422/80 |
| 4,300,952 | A | 11/1981 | Ingelstrom et al. | |
| 4,421,558 | A | 12/1983 | Morichika et al. | |
| 4,638,847 | A | 1/1987 | Day | |
| 4,778,522 | A | 10/1988 | Maki et al. | |
| 5,236,660 | A | 8/1993 | Reynaud et al. | |
| 5,242,510 | A | 9/1993 | Begin | |
| 5,316,596 | A | 5/1994 | Kataoka | |
| 5,573,572 | A | 11/1996 | Eckert et al. | |
| 5,738,734 | A | 4/1998 | Sawa et al. | |
| 5,894,010 | A | 4/1999 | Porkert et al. | |
| 6,013,141 | A | 1/2000 | Nylen et al. | |
| 6,395,107 | B1 * | 5/2002 | Subramanian | 148/321 |
| 6,508,981 | B1 | 1/2003 | Perrin et al. | |
| 6,582,537 | B1 | 6/2003 | Engl et al. | |
| 6,645,317 | B1 | 11/2003 | Brandenburg et al. | |
| 6,669,790 | B1 | 12/2003 | Grundlach et al. | |
| 6,706,240 | B2 | 3/2004 | Habecker et al. | |
| 6,767,412 | B2 | 7/2004 | Friedrich et al. | |
| 6,773,514 | B1 | 8/2004 | Kawalla et al. | |
| 6,800,152 | B2 | 10/2004 | Gundlach et al. | |
| 6,835,253 | B1 | 12/2004 | Kawalla et al. | |
| 6,855,218 | B1 | 2/2005 | Kawalla et al. | |
| 6,913,444 | B2 | 7/2005 | Kariya et al. | |
| 6,973,954 | B2 | 12/2005 | Ward | |
| 2005/0067067 | A1 | 3/2005 | Gehrmann et al. | |
| 2006/0191604 | A1 | 8/2006 | Itoh et al. | |

FOREIGN PATENT DOCUMENTS

| | | | |
|---|---|---|---|
| DE | 103 20 397 | | 12/2004 |
| EP | 0304530 | B1 | 5/1992 |
| JP | 01 028342 | | 1/1989 |
| JP | 02 258951 | | 10/1990 |
| SU | 1097703 | A * | 6/1984 |
| SU | 1 560 606 | | 4/1990 |
| WO | WO 03/095692 | | 11/2003 |

OTHER PUBLICATIONS

D. B. Craig et al., "Gray Iron," ASM Handbook v. 15, pp. 629-646, 1988.*

J.F. Janowak, R.B. Gundlach, A Modern Approach to Alloying Gray Iron, American Foundrymen's Society Transactions, 1982, pp. 847-863, vol. 90.

* cited by examiner

*Primary Examiner* — Roy King
*Assistant Examiner* — Christopher Kessler
(74) *Attorney, Agent, or Firm* — Finnegan, Henderson, Farabow, Garrett & Dunner LLP

(57) ABSTRACT

A gray cast iron alloy is disclosed. The gray cast iron alloy includes carbon from about 3.05 to about 3.40 weight percent, niobium from about 0.05 to about 0.3 weight percent, and silicon from about 1.75 to about 2.3 weight percent. The gray cast iron alloy also includes nickel less than or equal to about 0.06 weight percent.

15 Claims, No Drawings

HIGH STRENGTH GRAY CAST IRON

TECHNICAL FIELD

The present disclosure relates generally to gray cast irons and, more particularly, to gray cast irons with high strength.

BACKGROUND

In general, a cast iron is an alloy of iron, carbon, and silicon, in which more carbon is present than can be retained in solid solution in austenite at the eutectic temperature. The amount of carbon in cast iron is usually more than 1.7 percent and less than 4.5 percent. There are many types of cast iron that are used in industry. Pig iron, which is the product of a blast furnace, can be considered cast iron since it is iron cast into pigs or ingots for later re-melting and casting into the final form. Another alloy iron is the austenitic cast iron, which is modified by additions of nickel and other elements to reduce the transformation temperature so that the structure is austenitic at room or normal temperatures. Austenitic cast irons are usually used for applications that require a high degree of corrosion resistance. White cast iron is a type of cast iron, in which almost all the carbon is combined with iron as cementite. White cast iron is typically used for applications that require a high abrasion resistance. Another class of cast iron is called malleable iron. Malleable iron is produced by annealing white cast iron to change the structure of the carbon in the iron. By annealing, the cementite within white cast iron is decomposed to small compact particles of graphite (instead of flake -like graphite seen in gray cast iron), increasing the ductility of the material. There are two other classes of cast iron, which are ductile and known as nodular iron and ductile cast iron. Nodular and ductile cast iron are made by the addition of magnesium or aluminum, which will either tie up the carbon in a combined state or will give the free carbon a spherical or nodular shape. This structure provides a greater degree of ductility or malleability to the casting. There are also alloy cast irons that contain small amounts of chromium, nickel, molybdenum, copper, or other elements added to provide specific properties. These alloys usually provide higher strength cast irons. One of the major uses for the higher strength irons is casting automotive crankshafts. These alloys are sometimes called semi-steel or proprietary names.

The most widely used type of cast iron is known as gray iron. Its tonnage production exceeds that of any other cast metal. Gray iron has a variety of compositions, but it is usually such that the matrix structure is primarily pearlite with many graphite flakes dispersed throughout. Gray cast iron has a very low ability to bend and low ductility. The low ductility is due to the presence of the graphite flakes which act as discontinuities. Gray cast iron has a number of material properties, such as low pouring temperature, high fluidity, low liquid to solid shrinkage, etc., that make it suitable for castings. Gray cast iron is also easily available, and is among the cheapest forms of ferrous material. One industrial application where gray cast iron has found widespread use is the automotive industry. The ability to tailor the properties of gray cast iron with alloying elements makes it suitable for different automotive parts. For instance, a composition of gray cast iron tailored for thermal fatigue resistance is used for engine blocks and cylinder heads, while another composition of gray cast iron tailored for high thermal conductivity and specific heat capacity is used for disk brake rotors.

To meet new performance requirements and more stringent automotive exhaust standards, engines are required to run hotter and at higher pressures than previously manufactured engines. These hotter temperatures and higher pressures require increased strength and enhanced thermal fatigue resistance of the gray iron castings. This is especially true of engine cylinder heads, which are most susceptible to thermal fatigue damage and creep due to their proximity to the combustion chamber. During combustion of fuel, gases in the combustion chamber may approach temperatures as high as 1300° F., and pressure as high as 160 MPa. This heat may be conducted to the cylinder head. To keep the heat from being transferred back to the suction air in the combustion chamber during the suction stroke (which reduces suction efficiency and, ultimately, engine efficiency), the cylinder head may be cooled by circulating a coolant through channels therein. This cyclic heating and cooling of the cylinder head during engine operation, combined with the high mechanical stresses due to pressure on the cylinder walls, makes the cylinder head highly susceptible to thermal fatigue and creep. Studies have shown that thermal fatigue and creep resistance of the gray cast iron cylinder head depends upon the composition of the alloying elements in the gray cast iron.

Traditionally, molybdenum (Mo) and vanadium (V) were known to be the most effective contributors for enhancing thermal fatigue resistance. These elements were considered to be unique among traditional alloying elements to produce refinement in eutectic cell size of gray cast iron that leads to enhanced thermal fatigue resistance. U.S. Pat. No. 5,242,510 (hereinafter the '510 patent) issued to Begin on Sep. 7, 1993, discloses a gray cast iron containing molybdenum to improve the high temperature thermal fatigue resistance of automotive components. The cast iron alloy disclosed in the '510 patent has a carbon content ranging from 3.4 percent to 3.6 percent by weight, a primary alloying addition of the combination of molybdenum in amounts varying from 0.25 percent to 0.4 percent, and copper in amounts varying from about 0.3 percent to 0.6 percent. The cast iron alloy of the '510 patent also contains silicon between about 1.8 percent to 2.1 percent and manganese between about 0.5 to 0.9 percent, with no more that 0.25 percent chromium and 0.15 percent sulphur. Samples cast from the iron alloy of the '510 patent exhibited a microstructure of a fully pearlite matrix having a refined eutectic cell size. The microstructure also exhibited a substantially uniform graphite distribution with random orientation. The flake size of graphite in the microstructure of the '510 patent was predominantly 5-7 ASTM. Samples cast from the alloy of the '510 patent also exhibited a tensile strength of at least 40,000 psi (≈276 MPa) and a hardness between about 179 to about 229 BHN.

Although the gray cast iron alloy of the '510 patent may have acceptable thermal fatigue resistance and strength, the cost of molybdenum containing gray cast iron alloy may be high. Increased cost of the gray cast iron material may, in turn, adversely impact the suitability of the material for automotive (and other commercial) applications. Thus, a lower cost gray cast iron alloy with good thermal fatigue resistance and strength is needed for commercial applications.

The present disclosure is directed at overcoming one or more of the shortcomings of the prior high strength gray cast irons.

SUMMARY OF THE INVENTION

In one aspect, a gray cast iron alloy is disclosed. The alloy includes carbon from about 3.05 to about 3.40 weight percent, niobium from about 0.05 to about 0.3 weight percent, and silicon from about 1.75 to about 2.3 weight percent. The alloy also includes nickel less than or equal to about 0.06 weight percent.

In another aspect, a gray cast iron alloy which includes carbon from about 3.05 to about 3.40 weight percent, niobium from about 0.05 to about 0.3 weight percent, and sulphur from about 0.04 to about 0.15 weight percent is disclosed. The carbon in the alloy exists substantially in the form of graphite flakes of type A configuration having a flake size between 3-6, as defined by ASTM A247.

In yet another aspect, a casting made of a gray cast iron alloy is disclosed. The casting includes carbon from about 3.05 to about 3.40 weight percent. The carbon in the casting exists substantially in the form of graphite flakes of ASTM A247 type A. The casting also includes niobium from about 0.05 to about 0.3 weight percent, silicon from about 1.75 to about 2.3 weight percent, and a carbon equivalent less than or equal to about 4.1 weight percent. The tensile strength of the casting at room temperature varies from about 290 MPa to about 360 MPa.

DETAILED DESCRIPTION

Gray cast iron, so named because its fracture surface has a gray appearance, contains carbon in the form of graphite flakes in a matrix which consists of ferrite, pearlite or a mixture of the two. The properties of grey iron castings may be influenced by the shape and distribution of these graphite flakes. The standard method of defining graphite distribution and size is based on American Society for the Testing of Metals (ASTM) Specification A247, which classifies the form, distribution and size of the graphite. Under ASTM A247, flake morphologies are divided into five classes (type A-type E). Type A is a random distribution of flakes of substantially uniform size. Graphite flakes of type A are typically formed when a high degree of nucleation exists in the liquid iron, promoting solidification close to the equilibrium graphite eutectic. Type B graphite forms in a rosette pattern. The eutectic cell size of type B graphite is large because of the low degree of nucleation. Fine flakes form at the centre of the rosette because of undercooling and these coarsen as the structure grows. Type C structures typically occur in hypereutectic irons (described later), where the first graphite to form is primary kish graphite. Type D and Type E are fine, undercooled graphite flakes which form in rapidly cooled irons having insufficient graphite nuclei. This graphite morphology prevents the formation of a fully pearlitic matrix.

The ASTM specification also provides standards for measuring graphite flake size. This measurement is done by comparing a polished specimen of the alloy at a standard magnification of 100× with a series of standard diagrams provided in the specification. The size and type of the graphite flakes is largely a function of solidification temperature, cooling rate, and nucleation state of the melt. The graphite flakes act as stress raisers, which may prematurely cause localized plastic flow at low stresses, and initiate fracture in the matrix at higher stresses. As a result, gray cast iron exhibits minimal inelastic behavior, but excellent damping characteristics, and fails in tension without significant plastic deformation (termed, brittle behavior). The presence of graphite flakes also gives gray cast iron excellent machinability and self-lubricating properties.

In order to achieve a desired mechanical property in a gray iron casting, the liquid iron must have the correct composition and must contain suitable alloying elements to induce the correct graphite structure that form on solidification (termed, graphitization potential). The graphitization potential is determined, in part, by the carbon equivalent value (discussed later), and the silicon content in the alloy. For use of the alloy in castings with varying wall thicknesses, it is also important that the section size sensitivity of the properties of the alloy be low. In some cases, alloy elements added for strengthening cause increased section size sensitivity.

In addition to the formation of a consistent graphite structure, the gray cast iron alloy should be relatively free from chill, carbides, and free ferrite, and exhibit a fine pearlite microstructure with uniform strength and hardness. Chill refers to the portion of a casting that solidifies as white cast iron due to local accelerated cooling caused by contact with a metal surface of a mold. Carbides precipitate in cast iron during solidification. Although carbides may not be particularly detrimental to strength, they may adversely impact machinability. Free ferrite in the matrix may decrease the strength of the casting. Since pearlite is stronger than free ferrite, strength of the alloy may be maximized with the total elimination of free ferrite.

The principal function of the alloying elements is to control the transformation of austenite to achieve a fine pearlitic structure and, thereby, improve strength. Unfortunately, some alloying elements that aid in this transformation process have detrimental effects on the solidification process, resulting in chills and carbides. Therefore, good control of the composition of the alloying elements is required to produce an alloy with the desired characteristics. The approximate composition ranges of some of the constituents of the high strength gray cast iron of the present disclosure are listed in Table I below:

TABLE I

| Constituent | Approximate composition in percent by weight | Compositional range of samples (percent by weight) |
|---|---|---|
| Carbon (C) | 3.05 to 3.40 | 3.1 to 3.35 |
| Silicon (Si) | 1.75 to 2.30 | 1.9 to 2.2 |
| Carbon Equivalent (C.E) = % C + (% Si/3) | ≦4.10 | ≦4.08 |
| Manganese (Mn) | 0.5 to 0.70 | 0.5 to 0.6 |
| Minimum Manganese | 1.7 × (% S) + 0.3 | |
| Sulphur (S) | 0.04 to 0.15 | 0.09 to 0.15 |
| Phosphorous (P) | ≦0.06 | ≦0.02 |
| Nickel (Ni) | ≦0.06 | ≦0.04 |
| Copper (Cu) | ≦1 | ≦1 |
| Chromium (Cr) | ≦0.25 | ≦0.25 |
| Molybdenum (Mo) | 0.05 to 0.40 | 0.05 to 0.30 |
| Niobium (Nb) | 0.05 to 0.30 | 0.05 to 0.30 |
| Tin (Sn) | ≦0.10 | ≦0.10 |
| Iron (Fe) | Balance | Balance |

Carbon in the alloy may be present from about 3.05 to about 3.40 percent by weight, although in some embodiments, the composition of carbon may be from about 3.1 to about 3.35 percent by weight. Carbon may be the most important constituent of the alloy. With the exception of the carbon in the pearlite of the matrix, the carbon is present as graphite. The graphite flakes present in the alloy may exist primarily in the ASTM A247 Type A configuration and have a flake size ranging from 3-6. Although, the matrix consists predominantly of perlite, some ferrite and trace amounts of bainite and/or martensite may also be present. Steadite and carbides, if present, may not exceed a maximum of 2 percent and may be uniformly distributed as isolated non-massive particles or as a non-continuous network.

Silicon in the alloy may be present from about 1.75 to about 2.30 percent by weight. In some embodiments, the composition of silicon in the alloy may be from about 1.9 to about 2.2 percent by weight. Silicon may be added to the alloy to reduce chill and carbides. However, silicon may have negative effects on strengthening by promoting the formation of ferrites. Control of the composition of silicon may be important to achieve the desired properties of the alloy. The addition of silicon may reduce the solubility of carbon in iron, and may decrease the carbon content of the eutectic. Increasing the silicon content may decrease the carbon content of the pearlite and raise the transformation temperature of ferrite plus pearlite to austenite. The eutectic of iron and carbon is about 4.3 percent by weight. The addition of each 1.00 percent by weight of silicon reduces the amount of carbon in the eutectic by about 0.33 percent by weight.

Since carbon and silicon are the two principal elements in the alloy, the combined effect of these elements may be expressed as the carbon equivalent (C.E). The carbon equivalent is expressed as the percentage by weight of carbon in the alloy plus ⅓ the percentage by weight of silicon in the alloy. The C.E value of the disclosed alloy may be less than or equal to about 4.1 percent by weight. In some embodiments, the value of C.E may be less than or equal to about 4.08 weight percent. Gray cast irons having a carbon equivalent value of less than about 4.3 percent are designated hypo-eutectic irons, while those with more than about 4.3 percent carbon equivalent are called hyper-eutectic irons. Therefore, the cast iron alloys of this disclosure are hypo-eutectic iron alloys. For hypo-eutectic irons in the automotive and allied industries, each 0.10 percent increase in carbon equivalent value may decrease the tensile strength by about 18.6 MPa. If the cooling or solidification rate is too great for the carbon equivalent value of the alloy, the alloy may freeze in the iron-iron carbide metastable system rather than the stable iron-graphite system, which may result in hard or chilled edges on castings. The carbon equivalent value may be varied by changing either or both the carbon and silicon content. Increasing the silicon content may have a greater effect on reduction of hard edges than increasing the carbon content to the same carbon equivalent value.

Manganese in the alloy may be present from about 0.5 to about 0.7 percent by weight. In some embodiments, the concentration of manganese may be from about 0.5 to about 0.6 percent by weight. Most of the manganese in the alloy may be present as manganese sulphide. Manganese in excess of the amount required to tie up sulphur may retard ferrite formation and moderately refine pearlite. Only that portion of the manganese not combined with sulfur may be effective for this purpose. In some embodiments, the minimum concentration of manganese may be restricted to about (1.7×percent Sulfur)+0.3 percent or higher. For example, for an alloy with 0.05 percent sulphur, the concentration of manganese may be between about 0.5 and 0.7 percent by weight, and for an alloy with about 0.14 percent sulfur, the concentration of manganese may be between about 0.54 to about 0.7 percent by weight. Manganese is a strong pearlite promoter because it may stabilize austenite by increasing carbon solubility in austenite. Manganese may also reduce the equilibrium temperature of ferrite formation. Large additions of manganese to the alloy may upset the manganese-sulphur balance and alter the state of nucleation, resulting in a lower eutectic cell count and coarse or undercooled graphite.

Sulphur in the alloy may be present from about 0.04 to about 0.15 percent by weight. In some embodiments, the composition of sulphur may be from about 0.09 to about 0.15 percent by weight. Up to about 0.15 percent, sulfur may tend to promote the formation of Type A graphite. Beyond that, sulfur may lead to the formation of blowholes in castings.

The phosphorous content in the alloy may be less than or equal to about 0.06 percent by weight. In some embodiments, the phosphorous content in the alloy may be maintained less than or equal to about 0.02 percent by weight. Up to about 0.06 percent phosphorous may promote fluidity of the molten metal. Beyond that amount, the formation of iron phosphides may detrimentally affect casting properties. It is contemplated that, in some embodiments, the phosphorous content in the alloy may be as high as 0.08 percent when the chromium content is less than or equal to about 0.2 percent.

Copper and nickel need not be present in the alloy since the desired properties of the alloy can be achieved without the presence of these elements, and their addition increases the cost of the alloy. However, it is contemplated that in some embodiments of the alloy, copper and nickel may be present either as intentionally added alloying elements or as residual alloying elements. If present, copper concentration in the alloy may be less than or equal to about 1 percent by weight. Nickel, if present, may have a concentration of less than or equal to about 0.06 percent by weight. In some embodiments, the maximum concentration of nickel in the alloy may be less than or equal to about 0.04 percent by weight. Copper is a relatively strong pearlite promoter. Like tin, it may act as a barrier to carbon diffusion by accumulation at the austenite-graphite interface. Copper may only weakly refine pearlite. However, in combination with other alloying elements, such as molybdenum, copper may have a much greater hardenability effect. Like copper, nickel is also a weak pearlite refiner and, in combination with other alloying elements, such as molybdenum, nickel may have a greater hardenability effect. In general, both copper and nickel may behave in a similar manner in cast iron. That is, copper and nickel may strengthen the matrix and decrease the tendency to form hard edges on castings. Since copper and nickel are mild graphitizers, they may be substituted for some of the silicon in the alloy.

The chromium content in the alloy may be less than or equal to about 0.25 percent by weight. Chromium may be added to improve hardness and strength of the alloy. Chromium is a strong pearlite promoter because it increases carbon solubility in austenite and, thus, inhibits the formation of ferrite. Up to about 0.25 percent, chromium may improve the elevated temperature strength of the alloy. Beyond about 0.25 percent, however, chromium may promote chill and carbide formation during solidification.

Molybdenum may be used for improving the elevated temperature properties of the gray cast iron alloy. Molybdenum in the alloy may be present from about 0.05 to about 0.4 percent by weight. In some embodiments, the molybdenum concentration may be from about 0.05 to about 0.3 percent by weight. Traditionally, molybdenum is the most widely used alloying elements for the purpose of increasing the strength of gray cast iron. Best results may be obtained when the phosphorus content is below 0.10 percent, since molybdenum forms a complex eutectic with phosphorus and thus reduce its alloying effect. Since the modulus of elasticity of molybdenum is quite high, molybdenum additions may increase the modulus of elasticity of the alloy. The increased cost of molybdenum, however, may make molybdenum containing gray cast iron expensive. To reduce the cost of the alloy, the molybdenum in the alloy may be substituted with niobium.

Niobium in the alloy may be present from about 0.05 to about 0.3 percent by weight. To reduce cost, niobium may be substituted for molybdenum in the alloy. Therefore, in some embodiments of the alloy, a portion of the molybdenum may be substituted with niobium. It is contemplated that in some embodiments, where the molybdenum is substituted with niobium, the concentration of molybdenum may be closer to the lower end of the allowable range (that is, around 0.05 percent by weight) and the concentration of niobium may be closer to the higher end (that is, closer to about 0.3 percent by weight).

Tin in the alloy may be present up to about 0.1 percent by weight. Small additions of tin (less than 0.10 percent) may increase the stability of pearlite in the alloy. Above this limit, tin may cause embrittlement and other negative side effects in the alloy.

The balance of the composition of the alloy may be made up of iron. In addition to the constituents listed in Table I, the alloy may also include trace amounts of other impurities. Table II lists some of the impurities that may be present in the alloy along with their typical maximum concentrations. It must be emphasized that Table II is illustrative only, and the alloy may include impurities not listed in Table II. The concentration of one or more of the impurities may also exceed the typical maximum concentration listed in Table II.

TABLE II

| Impurity | Typical maximum concentration in percent by weight |
|---|---|
| Arsenic | 0.05 |
| Antimony | 0.02 |
| Bismuth | 0.005 |
| Boron | 0.01 |
| Cerium | 0.02 |
| Nitrogen | 0.02 |
| Tellurium | 0.003 |
| Vanadium | 0.05 |
| Zirconium | 0.1 |

INDUSTRIAL APPLICABILITY

The disclosed high strength gray cast iron can be used for the production of any article that may be exposed to high temperatures and/or thermal cycling conditions, and which require a high strength. The disclosed alloy can be used for components in engines and power systems. For example, the disclosed alloy can be used in diesel engine cylinder head castings, which require high strength and a thermal fatigue resistance sufficient to withstand the stresses and cyclic temperatures experienced by the cylinder heads. However, the present disclosure is not limited to these applications, as other applications will become apparent to those skilled in the art.

Any molding and innoculation process known in the art may be used to cast articles of the high strength gray cast iron. Non-limiting examples of suitable casting processes are, green sand molding, dry sand molding, shell molding, centrifugal casting, etc. Also, any cooling curve known in the art, that produces an alloy with the required graphite morphology and mechanical properties, may be used to cool the molten alloy.

Samples of different embodiments of the alloy having compositions within the range listed in Table I (listed under the column titled "compositional range of samples") were cast and subjected to metallurgical and mechanical tests. Among other tests, these samples were subjected to tensile and hardness tests, as per ASTM standard, in the as cast condition. The tensile strength of the samples tested were between about 290-360 MPa, and the hardness of the samples were between about 195-253 BHN. For the hardness testing, the samples were ground to a sufficient depth (approximately 1 mm) to void surface effects. It is contemplated that the tensile strength of the alloy may exceed 360 MPa, if machinability of the sample is not adversely affected. Adverse effect on machinability may be manifested by, among others, a decrease in tool life during machining, poor surface finish, etc.

Microstructural analysis of the casting of a 1.6 mm diameter field at 100× magnification revealed that the graphite morphology was primarily ASTM Type A with the flake size between 3 and 6. It is also contemplated that embodiments of the alloy may contain other flake types to the extent that the tensile strength of the sample is between about 290-360 MPa. The matrix of the sample consisted predominantly of pearlite. It is contemplated that, in some embodiments of the alloy, ferrite may also be present in the matrix to such an extent that the tensile strength of the alloy does not decrease below about 290 MPa. Bainite or martensite may also be present in the matrix, in trace amounts. In some embodiments, steadite and carbides may be present in the matrix up to a maximum limit of 2 percent. If steadite and carbides are present in the alloy, they may be uniformly distributed in the alloy as isolated non-massive particles, or as a non-continuous network.

Metallurgical and mechanical tests showed that the strength, thermal fatigue resistance, and other characteristics of the alloy met or exceeded those of typical molybdenum containing gray cast iron alloys. The increase in strength of the alloy is achieved by substituting molybdenum with niobium. Market study indicates that the cost of niobium is significantly lower that that of molybdenum. Therefore, reducing the molybdenum constituent in the high strength gray cast iron alloy may significantly decrease the cost of the alloy.

It will be apparent to those skilled in the art that various modifications and variations can be made to the disclosed high strength gray cast iron. Other embodiments will be apparent to those skilled in the art from consideration of the specification and practice of the disclosed high strength gray cast iron. It is intended that the specification and examples be considered as exemplary only, with a true scope being indicated by the following claims and their equivalents.

What is claimed is:

1. A gray cast iron alloy, comprising;
carbon from about 3.05 to about 3.40 weight percent;
niobium about 0.3 weight percent;
silicon from about 1.75 to about 2.3 weight percent;
nickel less than or equal to about 0.06 weight percent; and
molybdenum about 0.05 weight percent.

2. The gray cast iron alloy of claim 1, further including a carbon equivalent of less than or equal to about 4.1 weight percent.

3. The gray cast iron alloy of claim 1, further including;
sulphur from about 0.04 to about 0.15 weight percent; and
manganese from about 0.5 to about 0.7 weight percent.

4. The gray cast iron alloy of claim 3, wherein the minimum manganese concentration is greater than or equal to the larger of (1.7×concentration of sulphur) +0.3 and 0.5.

5. The gray cast iron alloy of claim 1, further including;
phosphorous less than or equal to about 0.06 weight percent; and
chromium less than or equal to about 0.25 weight percent.

6. The gray cast iron alloy of claim 1, wherein the carbon concentration is from about 3.1 to about 3.35 weight percent and the silicon concentration is from about 1.9 to about 2.2 weight percent.

7. The gray cast iron alloy of claim 1, further including;
tin less than or equal to about 0.1 weight percent; and
copper less than or equal to about 1 weight percent.

8. The gray cast iron alloy of claim 1, wherein the alloy has a tensile strength equal to or greater than about 290 MPa at room temperature when tested under ASTM test conditions.

9. The gray cast iron alloy of claim 8, wherein the alloy has a tensile strength less than or equal to about 360 MPa at room temperature when tested under ASTM test conditions.

10. The gray cast iron alloy of claim 8, wherein the alloy has a hardness value of about 195-253 BHN when tested at a depth sufficient to avoid surface effects.

11. An article made from the gray cast iron alloy of claim 1.

12. The article of claim 11, wherein the article is an engine cylinder head casting.

13. A gray cast iron alloy, comprising;

carbon from about 3.05 to about 3.40 weight percent;

molybdenum about 0.05 weight percent;

niobium about 0.3 weight percent; and sulphur from about 0.04 to about 0.15 weight percent.

14. The gray cast iron alloy of claim 13, further including;

silicon from about 1.75 to about 2.3 weight percent; and carbon equivalent of less than or equal to about 4.1 weight percent.

15. The gray cast iron alloy of claim 13 further including;

phosphorous less than or equal to about 0.06 weight percent;

minimum concentration of manganese greater than or equal to the larger of (1.7×concentration of sulphur) +0.3 and 0.5; and maximum concentration of manganese less than or equal to about 0.7 weight percent.

* * * * *